US011462812B2

(12) United States Patent
Nguyen et al.

(10) Patent No.: US 11,462,812 B2
(45) Date of Patent: Oct. 4, 2022

(54) HYBRID COUPLER

(71) Applicant: BAE SYSTEMS plc, London (GB)

(72) Inventors: Mark Christopher Nguyen, Great Baddow (GB); Gareth Michael Lewis, Great Baddow (GB)

(73) Assignee: BAE SYSTEMS PLC, London (GB)

( * ) Notice: Subject to any disclaimer, the term of this patent is extended or adjusted under 35 U.S.C. 154(b) by 330 days.

(21) Appl. No.: 16/640,831

(22) PCT Filed: Aug. 21, 2018

(86) PCT No.: PCT/GB2018/052365

§ 371 (c)(1),
(2) Date: Feb. 21, 2020

(87) PCT Pub. No.: WO2019/043358

PCT Pub. Date: Mar. 7, 2019

(65) Prior Publication Data

US 2020/0411943 A1 Dec. 31, 2020

(30) Foreign Application Priority Data

Aug. 31, 2017 (EP) ..... 17275130
Aug. 31, 2017 (GB) ..... 1713965

(51) Int. Cl.
*H01Q 13/00* (2006.01)
*H01P 3/08* (2006.01)
*H01P 5/22* (2006.01)

(52) U.S. Cl.
CPC . *H01P 5/22* (2013.01); *H01P 3/08* (2013.01)

(58) Field of Classification Search
CPC .. H01P 3/08; H01P 5/10; H01P 5/1015; H01P 5/12; H01P 5/18; H01P 5/19;
(Continued)

(56) References Cited

U.S. PATENT DOCUMENTS 3,678,395 A 7/1972 Hunton et al.
3,995,239 A * 11/1976 Head ..... H01P 5/1015 333/246

(Continued)

FOREIGN PATENT DOCUMENTS

GB 2503225 A 12/2013
GB 2503226 A 12/2013

(Continued)

OTHER PUBLICATIONS

International Search Report and Written Opinion received for PCT Application No. PCT/GB2018/052365. Dated Oct. 30, 2018. 20 pages.

(Continued)

*Primary Examiner* — Tho G Phan
(74) *Attorney, Agent, or Firm* — Finch & Maloney PLLC

(57) ABSTRACT

A hybrid coupler for dividing an input electrical signal to produce first and second output electrical signals which are substantially out of phase, the hybrid coupler including an input port for receiving the input electrical signal, and an input line for coupling the input electrical signal to a slotline. The hybrid coupler further includes an output line for coupling the first and second output electrical signals to a first output port and a second output port, respectively. The output line has a junction with the slotline. The hybrid coupler further includes a co-planar waveguide electrically connected to said output line and having a first end and an opposing second end, and defining, at the second end, a sum port configured to divert common mode signals received at said first and second output ports to said second end. The slotline transitions into the first end of the co-planar waveguide.

20 Claims, 6 Drawing Sheets

(58) Field of Classification Search
CPC . H01P 5/20; H01P 5/22; H01P 5/1007; H01Q 1/38; H01Q 13/00; H01Q 13/08
See application file for complete search history.

(56) References Cited

U.S. PATENT DOCUMENTS 4,644,302 A * 2/1987 Harris ..... H01P 5/12 333/125
4,818,964 A * 4/1989 Wong ..... H01P 5/182 333/113
5,001,492 A * 3/1991 Shapiro ..... H01P 5/187 333/116
5,075,647 A 12/1991 Petter
5,629,654 A * 5/1997 Frick ..... H01P 5/186 333/116
7,474,172 B2 * 1/2009 Runyon ..... H01P 5/04 333/117
7,830,224 B2 * 11/2010 U-Yen ..... H01P 5/1007 333/121
8,098,207 B1 * 1/2012 Herting ..... H01Q 1/281 343/774

FOREIGN PATENT DOCUMENTS

JP S60172802 A 9/1985
WO 0115260 A1 3/2001
WO 2019043358 A1 3/2019

OTHER PUBLICATIONS

GB Search Report under Section 17(5) received for GB Application No. 1713965.0 dated Feb. 12, 2018. 3 pages.
Extended European Search Report received for EP Application No. 17275130.7, dated Feb. 21, 2018. 11 pages.
Ashraf, et al., "Design of a Slot-coupled Ultra-Wideband 180° Hybrid Coupler," (2012) 15 International Symposium on Antenna Technology and Applied Electromagnetics, Published: IEEE, 2012, 4 pages.
Yang, et al., "Broadband Compact 180° Hybrid Derived From the Wilkinson Divider," IEEE Transactions on Microwave Theory and Techniques, vol. 58., No. 4, Apr. 2010. pp. 1030-1037.
International Preliminary Report on Patentability received for PCT Application No. PCT/GB2018/052365. Dated Mar. 12, 2020. 11 pages.

* cited by examiner

HYBRID COUPLER

This invention relates generally to a hybrid coupler and, more specifically but not necessarily exclusively, to a 180° hybrid coupler for use in, for example, an antenna arrangement. The invention also relates to antenna arrangements incorporating one or more hybrid couplers and associated methods of operating a hybrid coupler, with particular, but not necessarily exclusive, reference to microwave hybrid couplers.

A 4-port 180° hybrid coupler is a type of power divider or combiner. It can also be used as a balun. Baluns are well-known passive electrical devices. The term "balun" is derived from the abbreviation of the two terms 'balanced' and 'unbalanced'. Baluns are 3-port devices which convert signals from an unbalanced transmission line to a balanced transmission line, and vice versa. In general, the two balanced ports of a balun should provide a signal equal in amplitude with a 180° phase difference.

Microwave balun devices can be implemented in various ways, such as in transformer-type arrangements, coupled transmission lines and transmission line junctions. It is known from US2005/0105637 how to implement baluns using microwave techniques involving microstrips and slotlines.

A 4-port 180° hybrid coupler has the property that, from two inputs, the common or even mode will output from one port (the Σ or sum port), while the differential or odd mode will appear at a different port (the Δ or difference port). A four-port 180° hybrid coupler can be made into a 180° power divider (effectively a three-port balun) by terminating the sum port with a matched load, such that the load on the sum port absorbs some or all of the common-mode signal received at the output ports.

However, known 180° hybrid couplers tend to be relatively narrowband. It would, therefore, be desirable to improve the characteristics of these devices. In particular, it would be desirable to achieve a wider frequency range over which useful operation of the device can be achieved.

The present invention, in at least some of its embodiments, addresses the above described problems and desires.

According to a first aspect of the present invention, there is provided a hybrid coupler for dividing an input electrical signal to produce first and second output electrical signals which are substantially out of phase, the hybrid coupler including:

a first port comprising an input port for receiving the input electrical signal; an input line for coupling the input electrical signal to a slotline; and an output line for coupling the first and second output electrical signals to, respectively, second and third ports comprising, respectively, a first output port and a second output port, the output line having a junction with the slotline; wherein the slotline couples the input electrical signal to the junction, and the junction acts as a divider to produce the first and second electrical signals;

wherein the hybrid coupler further comprises:

an input section including said input line and an output section including said output line, and wherein the slotline is terminated at the output section by an output open circuit termination;

a pair of ground planes, between which said input line and said output line are located;

and wherein:

on one of the ground planes, the slotline transitions at said output section into a first end of a Co-Planar Waveguide, said Co-Planar Waveguide being electrically connected to said output line, said Co-Planar Waveguide defining, at a second, opposing end thereof, a sum port configured to divert common mode signals received at said first and second output ports to said second end thereof.

In an exemplary embodiment, the second end of said Co-Planar Waveguide may be connected, or otherwise coupled, to a matched load, a connector, or another form of transmission line interface.

The slotline may also be terminated at the input section by an input open circuit termination.

In a preferred embodiment, the Co-Planar Waveguide may comprise a generally central track having a first elongate portion extending in a direction from said input section toward said output open circuit termination, said first elongate portion being of a first width, an intermediate portion extending across said output open circuit termination and having a second width, different to said first width, and a second elongate portion extending beyond said output open circuit termination and having a third width different to said second width. Optionally, the first elongate portion of said Co-Planar Waveguide is nearest to the input section, said Co-Planar Waveguide extending from said first elongate portion in a direction toward said output ports, wherein said second portion of said Co-Planar Waveguide may be located between said first and second elongate portions, the sum port optionally being located at a distal end of said second elongate portion of said Co-Planar Waveguide.

In an exemplary embodiment, the first elongate portion may have a first impedance (e.g. 100Ω to match the transmission line) and the second elongate portion may have a second, different impedance (e.g. 50Ω to match a connector), and the widths of said first and second elongate portions may be different so as to transition from said first impedance to said second impedance within said Co-Planar Waveguide. This transition may, for example, be achieved by stepping or tapering the second elongate portion.

The distal end of said first elongate portion of the Co-Planar waveguide may be tapered to a point.

In an exemplary embodiment, the electrical connection between the Co-Planar Waveguide and the output line may comprise a blind via; and the co-planar waveguide may be substantially symmetrical about the slotline. In the latter case, the electrical connection between the Co-Planar Waveguide and the output line may be located generally centrally on the output line. Indeed, in an exemplary embodiment, the output line is beneficially symmetrical and may (optionally but not necessarily) be substantially U-shaped and the electrical connection between the Co-Planar Waveguide and the output line may be located generally centrally at the curved portion of the substantially U-shaped output line.

In an exemplary embodiment of the invention, at least one of the input line, slotline and output line has a width and a length and the width may vary over the length.

A hybrid coupler according to an exemplary embodiment of the present invention may be in the form of a microwave laminate structure.

According to a second aspect of the present invention, there is provided an antenna arrangement including an antenna which is fed electrical signals from a hybrid coupler substantially as described above.

According to a third aspect of the present invention, there is provided a method of operating a hybrid coupler substantially as described above, including: inputting an input electrical signal to the hybrid coupler, and outputting from the hybrid coupler first and second output electrical signals which are substantially out of phase.

According to a fourth aspect of the present invention, there is provided a method of operating a hybrid coupler substantially as described above, including: inputting an input electrical signal to the hybrid coupler, and outputting from the hybrid coupler first and second output electrical signals which are substantially of equal phase.

Whilst the invention has been described above, it extends to any inventive combination of the features set out above, or in the following description, drawings or claims.

Embodiments of devices in accordance with the invention will now be described, by way of examples only, and with reference to the accompanying drawings, in which.

Figure 1A:
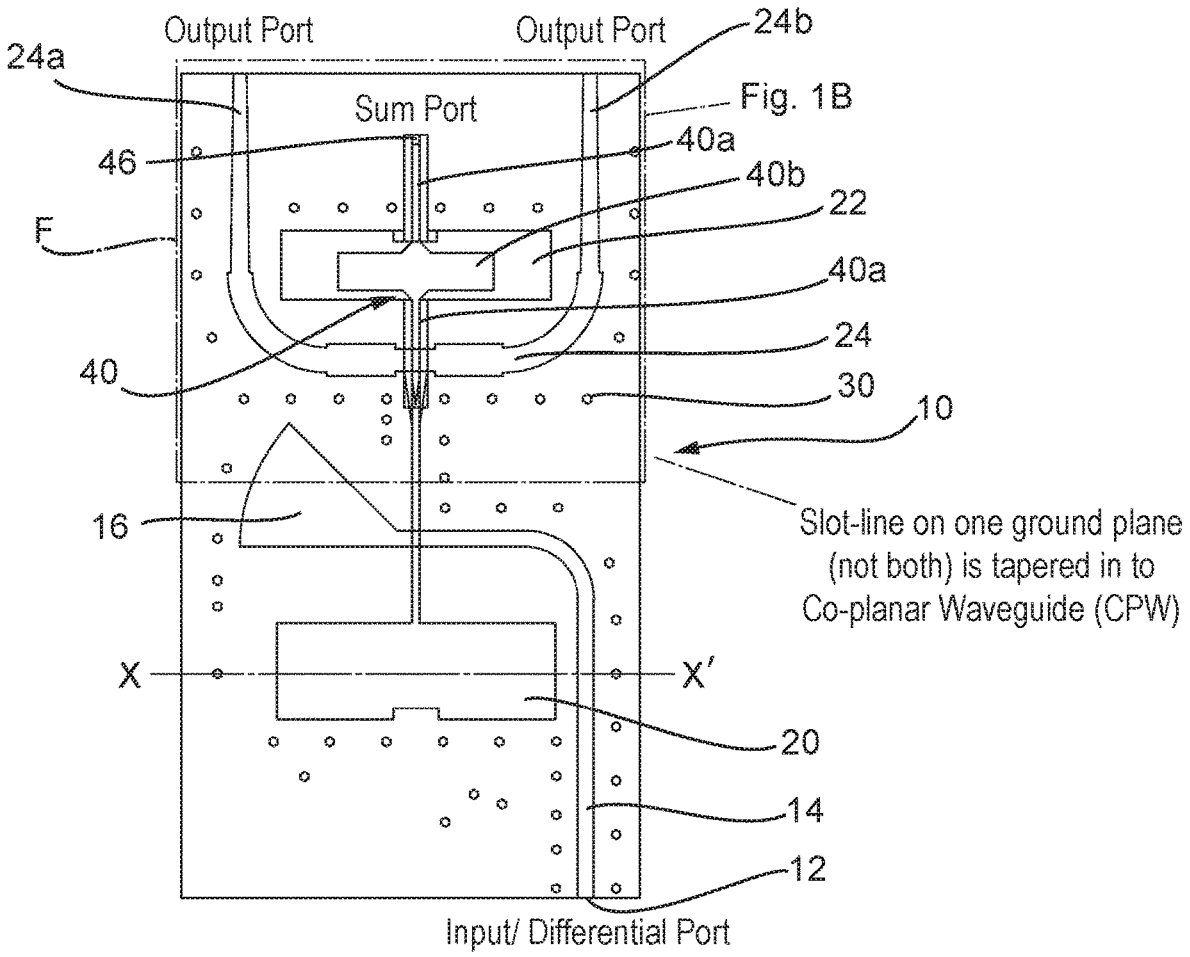
FIG. 1A illustrates a plan view of a 180° hybrid coupler in accordance with an exemplary embodiment of the present invention.
Figure 1B:
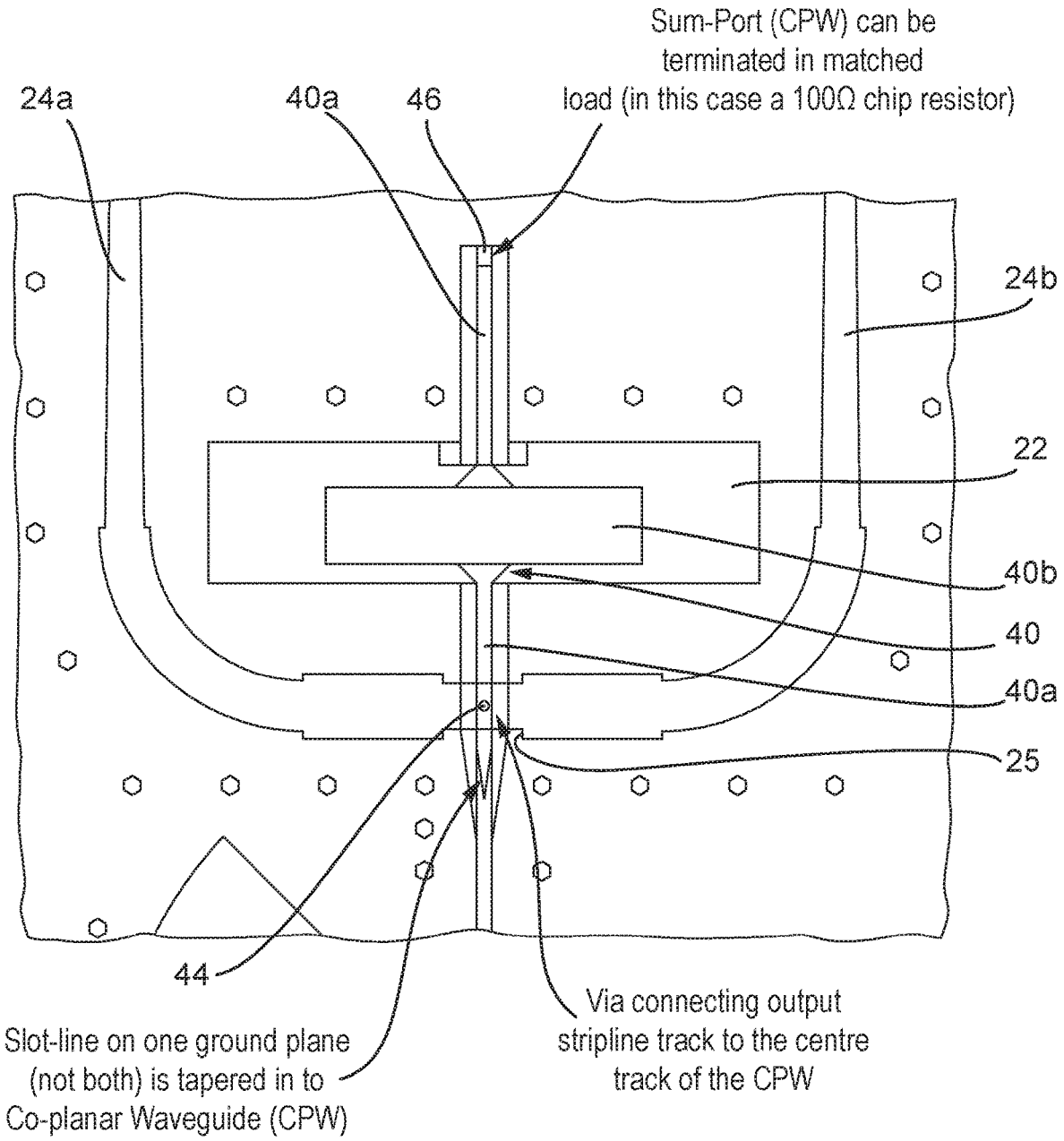
FIG. 1B is an expanded view of the region denoted 'F' of the hybrid coupler of FIG. 1A.
Figure 1C:
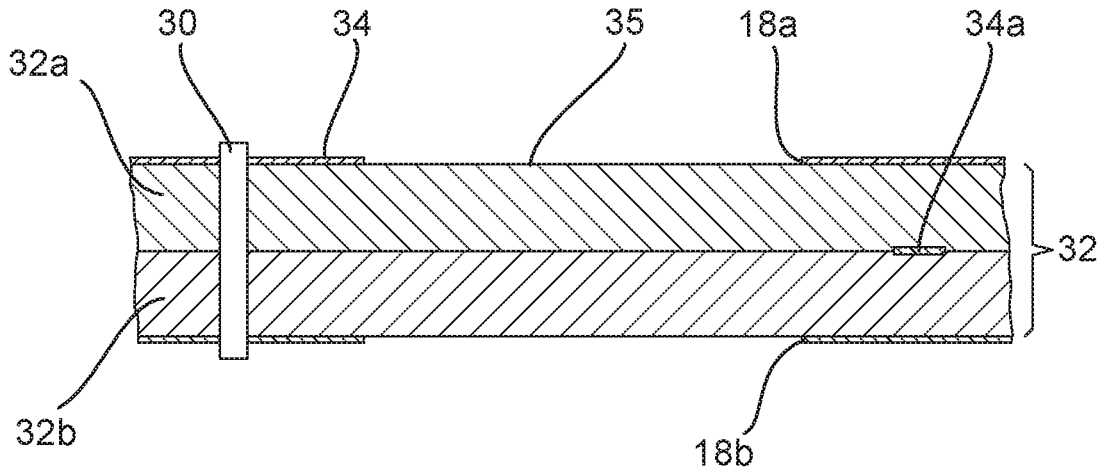
FIG. 1C is a cross-sectional view of the device of FIG. 1A along line X-X'.

Referring to FIGS. 1A, 1B and 1C of the drawings, a hybrid coupler according to an exemplary embodiment of the invention (depicted generally at 10) is illustrated in the form of a PCB. Thus, the device has first and second dielectric substrate layers which can be attached in a suitable manner, such as bond-ply. A copper layer (34—FIG. 1C) is provided on the outer surface of both the upper and lower ground planes to form ground planes for the stripline tracks, and a third copper layer is provided at the interface between the two substrate layers, and comprises a track layer creating stripline transmission line. The copper layers form part of the PCB and can be etched (to form slots and tracks) so as to form a required copper pattern on each of the three copper layers, as will be described in more detail hereinafter.

As shown in FIG. 1C of the drawings, at the cross-section denoted by line X-X', the device comprises a dielectric substrate 32 which is made up of the first substrate layer 32*a* and the second substrate layer 32*b* which can be attached in a suitable manner, such as by bond-ply. The layers of copper 34 on the outer surfaces of the substrate layers 32*a*, 32*b* are shown in thick lines and denoted by numeral 34. A copper layer 34*a* at the interface between the first and second substrate layers 32*a*, 32*b* is part of the stripline. The copper layers 34 are removed at the central region of the dielectric substrate 32 to leave a slot 35 which corresponds to open circuit 20 (FIG. 1A).

The 180° hybrid coupler 10 has an input port 12 leading to an input line or track 14, which can be a microstrip or a stripline. The input line 14 terminates in an open circuit stub 16. The hybrid coupler 10 also comprises a generally U-shaped output line 24 or track. The output line 24 can be in the form of a microstrip or a stripline.

Figure 2A:
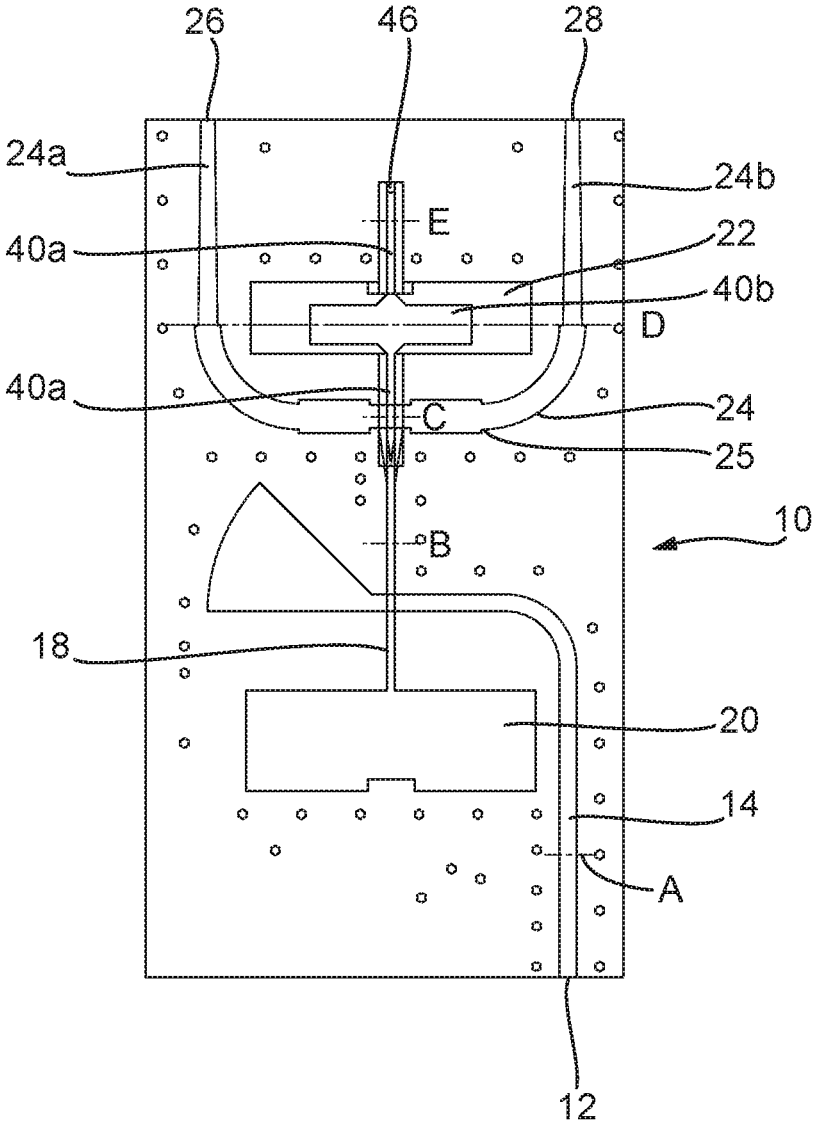
FIG. 2A illustrates a plan view of the hybrid coupler of FIG. 1A, including lines A-E denoting respective cross-sections of the device.

The hybrid coupler 10 further comprises a slotline 18. Indeed, in the stripline example, a slot (18*a*, 18*b*—FIGS. 2A/2B) is formed on both the upper and lower ground planes to form the slotline 18. On one of the ground planes (in this case, the upper ground plane although the present invention is not necessarily intended to be limited in this regard), the slotline 18 is terminated at both of its ends by open circuits 20, 22. Just prior to its termination by the stub 16, the input line 14 crosses the slotline 18 substantially at right angles to form an input line-slotline junction. This junction is formed towards the end of the slotline 18 which is closest to the input port 12. On the other of the ground planes, the slotline 18 transitions into Coplanar Waveguide (CPW) 40, wherein the centre track 40*a* of the CPW is connected to the output track 24 using a blind via 44, as will be described in more detail hereinafter.

The output line 24 crosses the slotline 18 substantially at right angles to form a junction. This junction is formed towards the end of the slotline 18 which is nearer the output ports 26, 28. The output line 24 can be regarded as comprising two arms or tracks 24*a*, 24*b*. The output track 24*a* connects the junction of the output track 24 with the slotline 18 to the output port 26. The output track 24*b* connects the junction of the output track 24 with the slotline 18 to the output port 28. The output track 24 is connected to the centre track 40*a* by a blind via at this junction.

The hybrid coupler 10 further comprises a plurality of circular vias 30 which, as would be readily understood by the skilled reader, are plated through holes in the PCB structure.

In use, an input electrical signal is inputted at the input port 12 and is coupled via the input line 14 and the slotline 18 to the junction between the slotline 18 and the output track 24. At this junction, substantially identical, contra-propagating electrical signals of opposite polarity are created which are coupled by the output tracks 24*a*, 24*b* to the output ports 26, 28.

By varying the width of one or more of the input line, slotline and output line, such as by steps or tapering, it is possible to vary the impedance along the length of the signal transmission track provided by the input line, slotline and output line. In this way, the impedances of the transmission line can be tuned so as to obtain a wideband input match. It can be seen that, in FIG. 1A, the widths of the input line 14, slotline 18, and both arms or output tracks 24*a*, 24*b* of the output line 24 are tapered. Additionally, each arm 24*a*, 24*b* has one or more stepped sections 25 arranged in a symmetrical fashion about the centre line.

The width of the microstrip, stripline or slotline transmission line determines its characteristic impedance at microwave frequencies. The impedance of the transmission track can thus be optimised by varying the width of the transmission track. Broadly speaking, this can be achieved by tapering or stepping the width. Tapered transmission lines are created when the width is gradually reduced or increased along the length of the transmission line. This can be done so as to vary the associated impedance in such a manner that the magnitude of the reflection coefficient is kept to a minimum, or at least reduced. In this way, transmission line impedances can be transformed from commonly used values, such as 50 ohms, to other impedances which are more desirable for optimum device performance, and design rules for various exemplary implementations are set out in detail in GB2503226.

Indeed, GB2503226 describes a three-port balun that provides very high levels of Common-Mode Rejection (often expressed as a ratio known as Common Mode Rejection Ratio or CMRR, relative to the desired Differential Mode). However, in certain applications, such as when such a balun is used to feed the antenna elements of an Electronically Scanned Phased Array Antenna (ESPAA), the reflected common-mode can give rise to unwanted resonances if the device is separated from the radiating element of the phased array antenna by a length of transmission line. The output section of the device (the slotline-to-stripline transition) will inherently reject any common mode signal received at the output ports. Therefore, in a phased array, where common mode currents are typically generated when the array is scanned away from boresight, these common mode currents will be reflected. Given that the balun is separated from the antenna radiating element by a length of stripline track, the two sources of mismatch (the balun and the radiating element) result in narrowband resonances in the return loss as seen at the input port of the balun. The frequency of these resonances correspond to the track length between the balun and the element being equal to one or more multiples of a wavelength.

The 180° hybrid coupler of the present invention is intended to address this issue and is effectively configured as a three-port balun, but which provides a matched termination to a common-mode signal appearing at the output ports, thereby adding a fourth port which allows the common mode currents to be diverted to a matched load (hereinafter referred to as the 'sum port' 46), rather than being reflected, as will now be described in more detail.

The 180° hybrid coupler of the present invention can be considered to have two sections, namely an input section and an output section. The input section consists of a differential port preceding a stripline-to-slotline transition, as described above, where both ground planes have identical slotline features (see 'B' of FIG. 2B). The input section includes a transition from the input line 14 (a stripline or microstrip track) to the slotline 18.

The output section has different slotline features for each of the two ground planes. On one of the ground planes (in this case the 'upper' ground plane, as the device is oriented in FIG. 2B), there is a slotline-to-stripline transition, as described above. However, on the other ground plane (in this case, the 'lower' ground plane), there is a transition from the slotline 18 to the output track 24 (two striplines or microstrip tracks 24*a*, 24*b*). More specifically, the slotline 18 transitions into CPW 40, with the centre track 40*a* of the CPW connected to the output stripline track 24 using a copper-plated blind via 44. The centre track 40*a* of the CPW broadens out (at 40*b*) underneath the cavity forming the second open circuit 22 in order to maintain, as far as is possible, the transmission line impedance, and is terminated at the sum port 46 (in this case, the sum port 46 is terminated in a chip resistor, i.e. a matched load; however, the matched load could, in alternative embodiments, be replaced with a connector or other interface such that all four ports of the device are available for use). The two arms 24*a*, 24*b* of the output track 24 are routed around (in a general U shape, as previously described) to create the two output ports 26, 28.

Figure 2B:
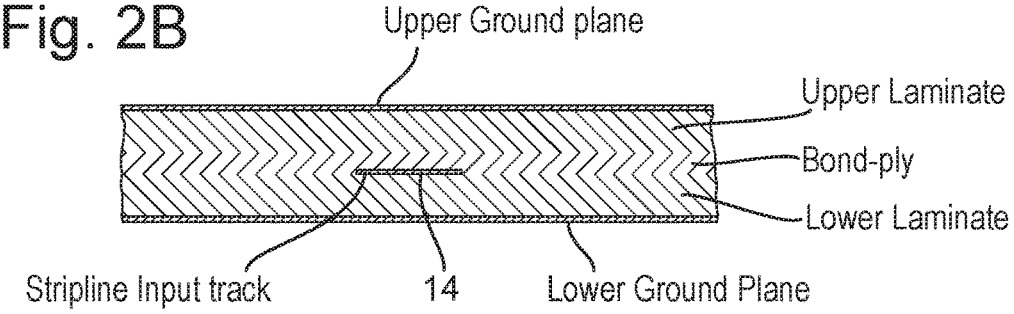
FIG. 2B illustrates cross-sectional views along lines A-E.
Figure 2C:
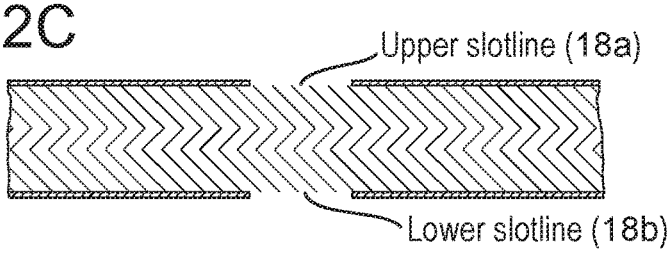
FIGS. 2C-2F illustrate various cross-sectional views of the hybrid coupler.
Figure 2D:
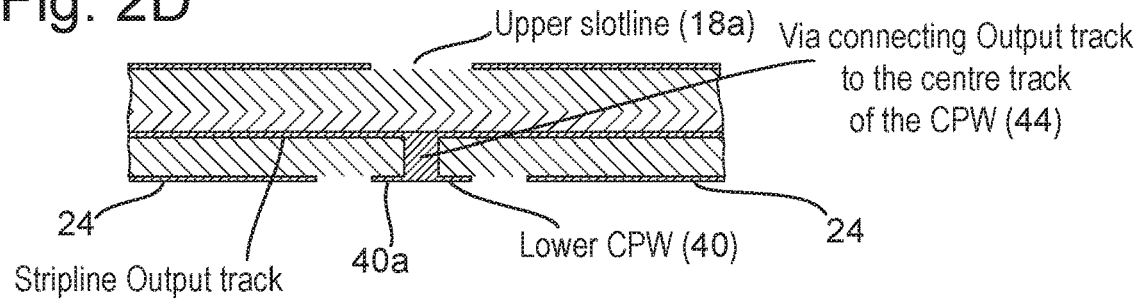
Figure 2E:
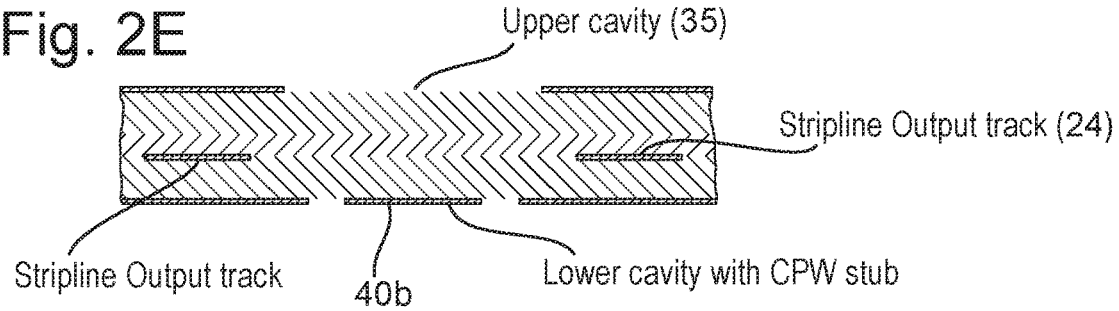
Figure 2F:
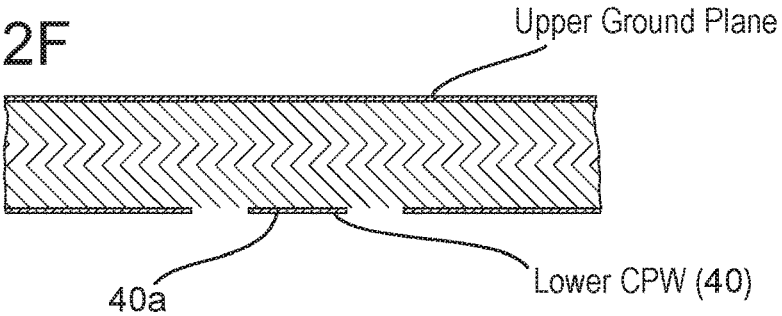

Referring additionally to FIG. 2B of the drawings, on one of the ground planes only (in this case, the 'lower' ground plane), the slotline that feeds the output cavity 22 and output tracks 24*a*, 24*b* transitions into Co-Planar Waveguide (CPW) 40. Methods of forming or providing a CPW on a PCB in this manner will be well known to a person skilled in the art, and will not be discussed in great detail herein. Suffice it to say that a CPW of this type comprises the central track 40*a*,40*b* and a pair of ground conductors, one on each side (but spaced apart from) the central track 40. The central track 40*a*, 40*b* and ground conductors are co-planar relative to each other, hence the term Co-Planar Waveguide or CPW.

The centre track 40*a* at the input end of the CPW is connected to the output track 24 using a blind via 44, i.e. a via that only extends through a portion of the PCB structure. Based upon the dimensions of the slotline output cavity (or open circuit) 22 on the other (i.e. 'upper') ground plane layer, the centre track 40*a* of the CPW 40 broadens out (at 40*b* corresponding to the location of the output cavity 22) to maintain the transmission line impedance, as far as is possible. Beyond the output cavity 22 (at the output end), the centre track 40*a* of the CPW 40 returns to its original dimensions.

Thus, as shown in 'C' of FIG. 2B (and at cross-sectional line 'C' of FIG. 2A), the centre track 40*a* of the CPW 40 is relatively narrow and tapers to a point in the direction from the output cavity 22 toward the input end of the device. At 'D' of FIGS. 2A and 2B, the centre track 40*a* of the CPW 40 broadens out at 40*b* to take account of the output cavity 22 and maintain the transmission line impedance, as far as is possible. Finally at E, beyond the output cavity 22 (in the direction of the output end of the device), the centre track 40*a* of the CPW 40 returns to its original dimensions and terminates at the sum port 46. In this example, the CPW 40 is terminated (at the sum port 46) in a matched load beyond the output cavity 22. However, the matched load could be replaced by a connector or other interface in order that all four ports of the device are available. It will be understood by a person skilled in the art that, if the device is to be used in an antenna arrangement, access to the sum port is unlikely to be required. However, when used in other applications, for example, as part of a beamformer, access to both the sum and difference ports might be required. If a connector is used to provide an interface, it would need to be matched to the transmission line impedance. In the case of the present exemplary embodiment of the present invention, the transmission line impedance is approximately 100Ω, but 100Ω is not a standard impedance for connectors and so an impedance transformer would be required (which, for wide bandwidths, could simply be a tapered transmission line).

When the two output arms 24*a*, 24*b* are fed with signals of equal amplitude and phase, the common mode signal couples from the output track to the CPW 40 using the blind via 44 that connects the two. The blind via 44 is located at the centre track 40*a* of the CPW 40 at the input end, adjacent the centre of the curved portion of the substantially U-shaped output line 24. As slotline does not support a common mode signal, the signal is coupled from the output stripline track 24 into the CPW 40 rather than the slotline 18. This allows the common mode signal to be directed into the load beyond the output cavity 22. The performance is reciprocal. Thus, if the sum port 46 is fed, the signal is divided between the two output ports 26, 28, with the signal at each port being of equal amplitude and phase. When the two output arms 24*a*, 24*b* are fed with signals of equal amplitude but 180° out of phase with each other, the differential mode couples to the slotline 18 and propagates towards the input sections, as in the balun design of GB2503226, for example. Both slotline 18 and CPW 40 support a differential mode, but in this case, the CPW 40 still appears to be terminated by an open circuit cavity (22) and so the signal does not propagate beyond this cavity. By placing the blind via 44 that connects the output track 24 to the centre of the CPW 40 on the centre-line geometry, it does not affect the propagation of the differential signal. The performance is again reciprocal. Thus, if the differential port 12 is fed, the signal is divided between the two output ports 26, 28, with the signal at each port being of equal amplitude but 180° out of phase with each other.

The slotline-to-CPW transition between the input cavity 20 and the output cavity 22 allows any differential signal from the input port 12 to propagate in the manner described above, in relation to a known balun. However, for any common mode signal appearing at the output ports 26, 28, and because the slotline (at the output section) does not support the common-mode, the signal is exclusively coupled from the output stripline track 24 into the CPW 40, rather than being reflected. This allows the common mode signal to be directed into the load beyond the output cavity 22 (at the sum port 46). The slotline (at the output section) does not support the common-mode, so no common-mode signal is able to propagate to or from the differential port 12, and because the via 44 linking the output stripline track 24 to the centre track 40*a* of the CPW 40 is on the centre line of the circuit (and the CPW 40 is effectively terminated by an open circuit cavity), no differential mode signal is transferred to the CPW 40, i.e. no differential mode signal is transferred to or from the sum port 46. These two characteristics mean the isolation between the sum and difference ports is very good.

Figure 3A:
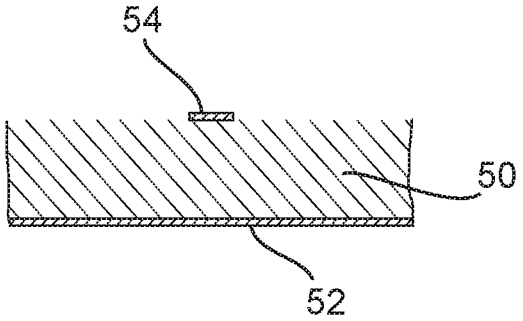
FIGS. 3A-3C show cross sectional views of (a) a microstrip, (b) a stripline, and (c) a slotline.
Figure 3B:
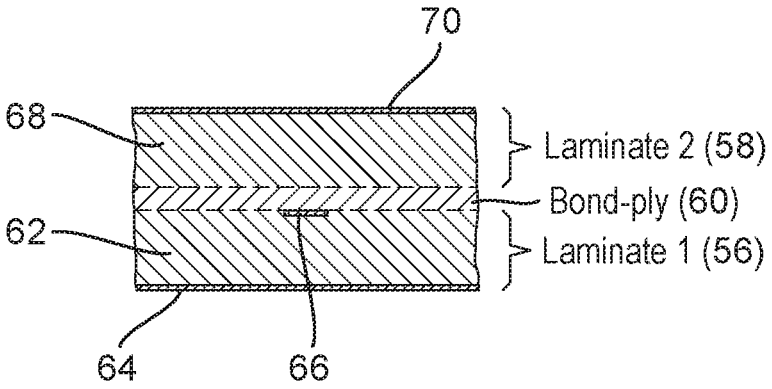
Figure 3C:
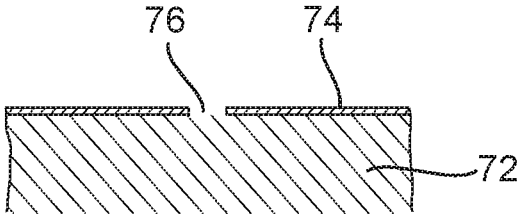

A wideband 180° hybrid coupler, such as that described above with reference to FIGS. 1 and 2, can be fabricated using standard microwave PCB manufacturing techniques. For microwave devices of this type, PCBs are generally of the type known as microwave laminates which make use of low-loss copper-clad dielectric substrates. Suitable PCBs can be obtained from a variety of manufacturers who will be well known to the skilled reader, such as Rogers Corporation (Rogers CT 06263, USA) and Taconic (Petersburg, N.Y. 12138, USA). The device structure can be produced by removing copper from desired areas of one or both sides of the laminate. It is also possible to bond laminate sheets together to form multi-layer structures. Multi-layer structures may have multiple combinations of microstrip, stripline or slotline transmission lines. Copper removal is performed to provide copper patterns which are used to form the desired microstrip, stripline or microstrip features. FIG. 3 shows generalised cross-sectional views of (a) a microstrip, (b) a stripline and (c) a slotline. FIG. 3(*a*) shows a microstrip formed from a microwave laminate comprising a dielectric substrate 50 having a full copper layer 52 on a lower face thereof. Copper has been removed on the upper face of the dielectric substrate 50 to leave a copper track 54. FIG. 3(*b*) shows a stripline formed as a multi-layer structure comprising a first microwave laminate 56, and second microwave laminate 58, and a bond-ply sheet 60 which is used to secure the laminates 56, 58 to each other. The first microwave laminate 56 comprising a dielectric substrate 62 having a complete copper layer 64 formed over a lower face thereof. Copper is removed on the upper face of the dielectric substrate 62 to leave a copper track 66. Copper is removed entirely from a lower face of a dielectric substrate 68 of the microwave laminate 58. The upper face of the dielectric substrate 68 retains a complete copper layer 70. Typically, vias (also known generally as Plated Through Holes or PTH) are used to limit the propagation of parallel plate modes resulting from the asymmetry caused by the bond-ply 60. FIG. 3(*c*) shows a slotline formed from a microwave laminate which comprises a dielectric substrate 72 having a copper layer 74 on an upper face thereof. Copper is removed from the copper layer 74 to create a slot 76. The copper on the lower face of the dielectric substrate 72 may be removed entirely.

Hybrid couplers according to embodiments of the invention are particularly suitable for use in feeding an antenna. An array of couplers may be utilised. However, the hybrid couplers of the invention may be used for other purposes, such as in a microwave circuit.

It will be apparent to a person skilled in the art that the term wideband includes operating over a multi-octave frequency range. It will also be apparent to a person skilled in the art that the term narrowband is not the same as wideband.

Further, it will be apparent to a person skilled in the art, from the foregoing description, that modifications and variations can be made to the described embodiment, without departing from the scope of the invention as defined by the appended claims.

The invention claimed is:

1. A hybrid coupler for dividing an input electrical signal to produce first and second output electrical signals which are substantially out of phase, the hybrid coupler including:

a first port comprising an input port for receiving the input electrical signal;

an input line for coupling the input electrical signal to a slotline;

an output line for coupling the first and second output electrical signals to, respectively, second and third ports comprising, respectively, a first output port and a second output port, the output line having a junction with the slotline, wherein the slotline couples the input electrical signal to the junction, and the junction acts as a divider to produce the first and second electrical signals;

an input section including said input line and an output section including said output line, and wherein the slotline is terminated at the output section by an output open circuit termination;

a pair of ground planes, between which said input line and said output line are located; and a co-planar waveguide, said co-planar waveguide being electrically connected to said output line, said co-planar waveguide having a first end and an opposing second end and defining, at the second end, a sum port configured to divert common mode signals received at said first and second output ports to said second end;

wherein on one of the ground planes, the slotline transitions at said output section into the first end of the co-planar waveguide.

2. The hybrid coupler according to claim 1, wherein said second end of said co-planar waveguide is coupled to a matched load, a connector, or transmission line interface.

3. The hybrid coupler according to claim 1, wherein said slotline is terminated at the input section by an input open circuit termination.

4. The hybrid coupler according to claim 1, wherein said co-planar waveguide comprises a generally central track having a first elongate portion extending in a direction from said input section toward said output open circuit termination, said first elongate portion being of a first width, an intermediate portion extending across said output open circuit termination and having a second width, different to said first width, and a second elongate portion extending beyond said output open circuit termination and having a third width different to said second width.

5. The hybrid coupler according to claim 4, wherein said first elongate portion of said co-planar waveguide is nearest to the input section, said co-planar waveguide extending from said first elongate portion in a direction toward said output ports, wherein said second portion of said co-planar waveguide is located between said first and second elongate portions, the sum port being located at a distal end of said second elongate portion of said co-planar waveguide.

6. The hybrid coupler according to claim 4, wherein the first elongate portion has a first impedance and the second elongate portion has a second, different impedance, and the widths of said first and second elongate portions are different so as to transition from said first impedance to said second impedance within said co-planar waveguide.

7. The hybrid coupler according to claim 4, wherein a distal end of said first elongate portion of the co-planar waveguide is tapered to a point.

8. The hybrid coupler according to claim 1, wherein the co-planar waveguide is electrically connected to the output line by an electrical connection that comprises a blind via.

9. The hybrid coupler according to claim 1, wherein the co-planar waveguide is substantially symmetrical about the slotline.

10. The hybrid coupler according to claim 9, wherein the co-planar waveguide is electrically connected to the output line by an electrical connection that is located generally centrally on the output line.

11. The hybrid coupler according to claim 10, wherein the output line is substantially symmetrical about said electrical connection.

12. The hybrid coupler according to claim 11, wherein the output line is substantially U-shaped and the electrical connection between the co-planar waveguide and the output line is located generally centrally at the curved portion of the substantially U-shaped output line.

13. The hybrid coupler according to claim 1, wherein at least one of the input line, slotline, and output line has a width and a length and wherein the width varies over the length.

14. A microwave laminate structure including the hybrid coupler according to claim 1.

15. An antenna arrangement including an antenna which is fed electrical signals from the hybrid coupler according to claim 1.

16. A method of operating a hybrid coupler, the method comprising inputting an input electrical signal to the hybrid coupler, and outputting from the hybrid coupler first and second output electrical signals, wherein the hybrid coupler includes:

a first port comprising an input port for receiving the input electrical signal;

an input line for coupling the input electrical signal to a slotline;

an output line for coupling the first and second output electrical signals to, respectively, second and third ports comprising, respectively, a first output port and a second output port, the output line having a junction with the slotline, wherein the slotline couples the input electrical signal to the junction, and the junction acts as a divider to produce the first and second electrical signals;

an input section including said input line and an output section including said output line, and wherein the slotline is terminated at the output section by an output open circuit termination;

a pair of ground planes, between which said input line and said output line are located; and a co-planar waveguide, said co-planar waveguide being electrically connected to said output line, said co-planar waveguide having a first end and an opposing second end and defining, at the second end, a sum port configured to divert common mode signals received at said first and second output ports to said second end;

wherein on one of the ground planes, the slotline transitions at said output section into the first end of the co-planar waveguide.

17. The method of claim 16, wherein the first and second output electrical signals are substantially of equal phase.

18. The method of claim 16, wherein the first and second output electrical signals are substantially 180 degrees out of phase.

19. A signal coupler for dividing an input electrical signal to produce first and second output electrical signals, the coupler including:

an input port for receiving the input electrical signal;

a slotline;

an input line for coupling the input electrical signal to the slotline;

an output line for coupling the first and second output electrical signals to, respectively, a first output port and a second output port, the output line having a junction with the slotline, wherein the slotline couples the input electrical signal to the junction, and the junction acts as a divider to produce the first and second electrical signals;

a pair of ground planes, between which said input line and said output line are located; and a co-planar waveguide, said co-planar waveguide being electrically connected to said output line, said co-planar waveguide having a first end and an opposing second end and defining, at the second end, a sum port configured to divert common mode signals received at said first and second output ports to said second end;

wherein on one of the ground planes, the slotline transitions into the first end of the co-planar waveguide.

20. A printed circuit board or system including the coupler of claim 19.

* * * * *